United States Patent [19]

Streubel

[11] Patent Number: 4,721,151

[45] Date of Patent: Jan. 26, 1988

[54] MOLD FOR CONTINUOUS CASTING OF METAL STRIP

[75] Inventor: Hans Streubel, Ekrath, Fed. Rep. of Germany

[73] Assignee: SMS Schloemann-Siemag Aktiengesellschaft, Dusseldorf, Fed. Rep. of Germany

[21] Appl. No.: 5,625

[22] Filed: Jan. 21, 1987

[30] Foreign Application Priority Data

Jan. 20, 1986 [DE] Fed. Rep. of Germany ..... 3601501

[51] Int. Cl.[4] ..... B22D 11/04

[52] U.S. Cl. ..... 164/418

[58] Field of Search ..... 164/418, 459

[56] References Cited

U.S. PATENT DOCUMENTS 4,635,702 1/1987 Kolakowski et al. ..... 164/418

*Primary Examiner*—Kuang Y. Lin

*Attorney, Agent, or Firm*—Russell & Tucker

[57] ABSTRACT

A mold is provided for continuously casting strip metal in which the mold cavity is formed with a flared mouth the internal surfaces of which terminate at their lower end along a transversely extending line, and the reflex angles which the mold along that line at a maximum near the center line of the mold and gradually diminishing toward the side edges of the mold.

9 Claims, 6 Drawing Figures

MOLD FOR CONTINUOUS CASTING OF METAL STRIP

FIELD OF THE INVENTION

This invention relates to the continuous casting of metal strip, and more particularly to a mold for same. Still more particularly it relates to a mold formed for the reduction of the risk of break-outs, and mold wear.

BACKGROUND OF THE INVENTION

Molds in use of this purpose employ a pouring zone shaped as an elongated funnel having respectively opposed broad and narrow walls in which the faces over which the stock must pass in the forming direction are triangular in shape. To the side of the pouring zone the walls of the mold extend parallel out to the narrow walls (DE-OS No. 34 00 220).

In these prior molds the surface portion of the strip which starts to congeal as the stock proceeds and is being reduced in thickness through the pouring zone, is subjected to bending stress as the stock flows in the casting direction over a reflex angle formed by the mold walls. This bending stress leads to break-outs. In order to reduce this bending stress the angles are kept small. This is a disadvantage in that the mold must be correspondingly longer.

It is an object of this invention to overcome the disadvantages of the known construction. In particular it is an object of the invention to provide a mold which is less prone to break-out than the conventional form, which reduces the bending stress on the stock as it passes over the transition point in the mold between the widened or flared pouring zone and the parallel faces of the mold further downstream. Still another object is to reduce mold wear, as well as to reduce the force necessary to extract the stock from the pouring mold. A still further object is to improve the distribution of the stock in the mold between the sides and the middle.

BRIEF DESCRIPTION OF THE INVENTION

In the accomplishment of these and other objects of the invention, in an illustrative example thereof, the mold is provided with substantially rectangular faces in the widened or flared area of the pouring zone, and the surfaces over which the stock must pass formed along a transversely extending line C-D with gradually diminishing reflex transition angles as the stock passes into the lower, stock forming zone of the broad walls of the mold. The effect of this is materially to reduce the bending stress to which the stock, and particularly its congealed surface, is subjected. This is done by making the angles more "stream-lined". Not only does it reduce the bending stress but also it improves the distribution of the stock to the sides of the mold. This makes it possible to pour more difficult types of steel, as well as to continuously cast thinner strip.

Another feature of the invention is that, the faces of the mold in the pouring zone are provided with especially favorable transition angles, by shaping the mold so that substantially rectangular areas are formed with corners connected by straight lines A-B and C-D, and in between these lines the surface is formed by straight lines running from line A-B to line C-D substantially in the line of the flow of the stock. Another feature is that the lines A-B need not be straight. This further enhances the gradual change of the transition angle along line C-D from maximum at D to zero at C.

BRIEF DESCRIPTION OF THE DRAWINGS

Embodiments of the invention chosen for purposes of illustration only are shown in the accompanying drawings in which.

DETAILED DESCRIPTION OF THE INVENTION

Figure 1:
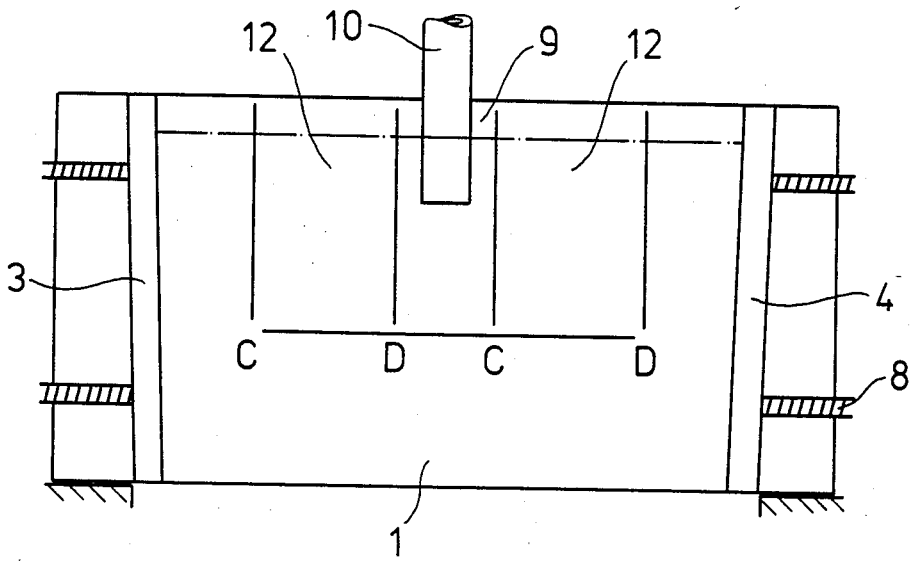
FIG. 1 is a view in cross section within the mold looking directly at one of the broad walls, along the lines I—I of FIG. 2.
Figure 2:
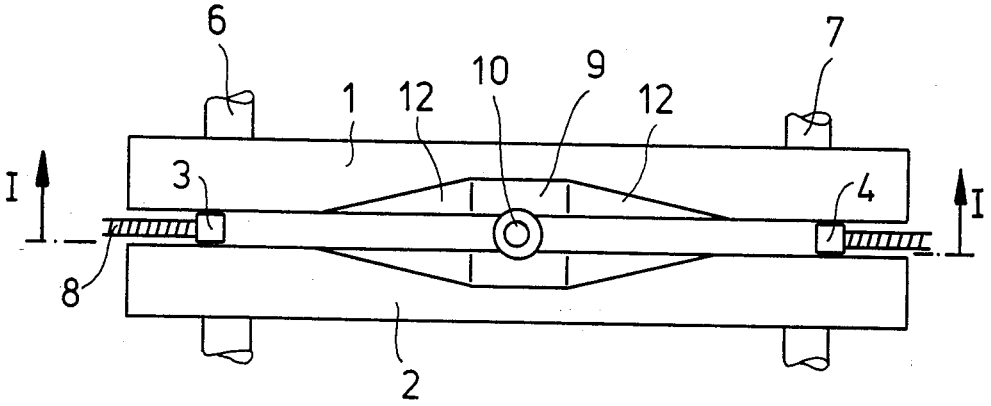
FIG. 2 is a plan view from above looking down on the mold.
Figure 3:
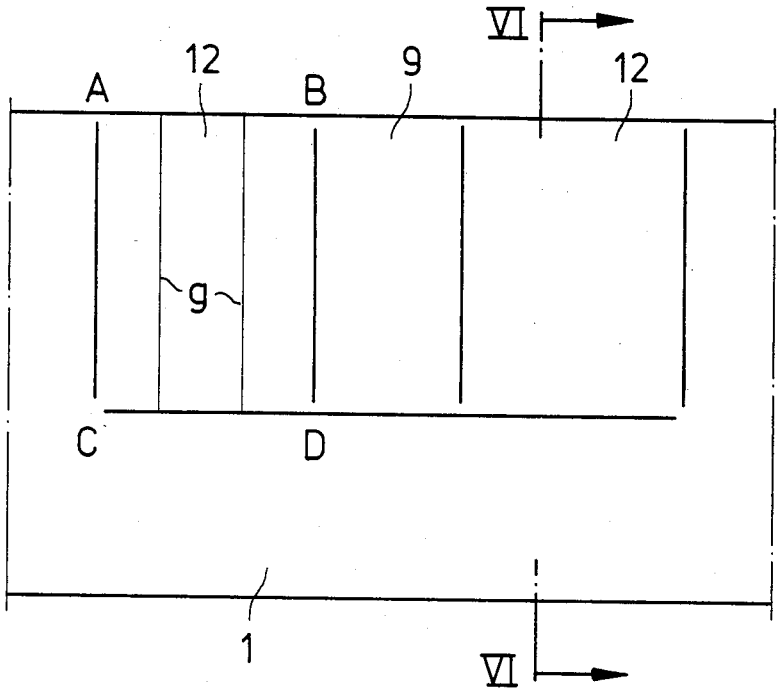
FIG. 3 is a diagramatic view explaining the surfaces in the pouring zone of the mold.

The illustrative embodiment of the invention, herein shown comprises a mold for continuously casting steel strip having a mold cavity formed by generally opposed respectively broad and narrow walls, 1,2 and 3,4. These walls are provided, as is customary, with internal cooling ducts 5. The narrow side walls are adjustable by means of screw elements 8. The mold cavity has an inlet and an outlet end.

The mold cavity walls 1,2 are flared near the inlet end to provide an enlarged pouring zone 9 which gradually tapers in the direction of the flow of the stock. A molten metal pouring tube 10 is positioned centrally of the mold over the pouring zone and projecting into it.

Figure 6:
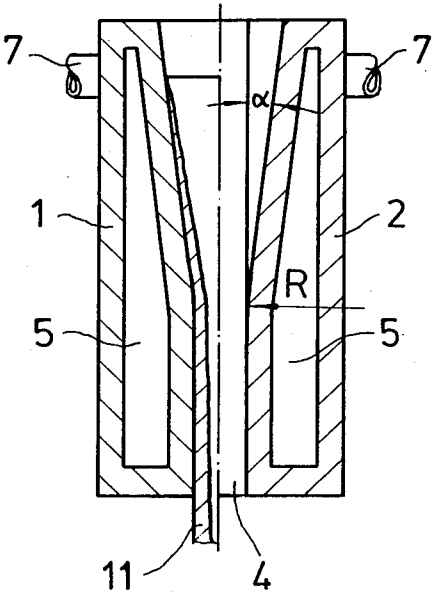
FIG. 6 is an end view in cross section along the lines VI—VI of FIGS. 3 and 5.

As the stock proceeds through the pouring zone and is reduced in thickness, its surface congeals (see FIG. 6). In order to minimize the bending stress exerted on the stock during the transition between the pouring zone and the parallel faces of the mold further downstream, the mold is provided with widened, somewhat rectangular faces defined by the lines A,B,C,D. The transition from the tapering pouring zone to the portion of the mold near the outlet end occurs as the stock flows over a reflex angle within the mold along a generally transversely extending line C-D.

The contour of the faces of the generally rectangular area are formed with lines g running vertically between equi-spaced points along lines A and B, and C and D respectively, which subtend reflex transition angles between the stock flow line and the walls which gradually reduce from 10 degrees at point D to 0 degrees (i.e., no reflex angle) at point C.

Figure 5:
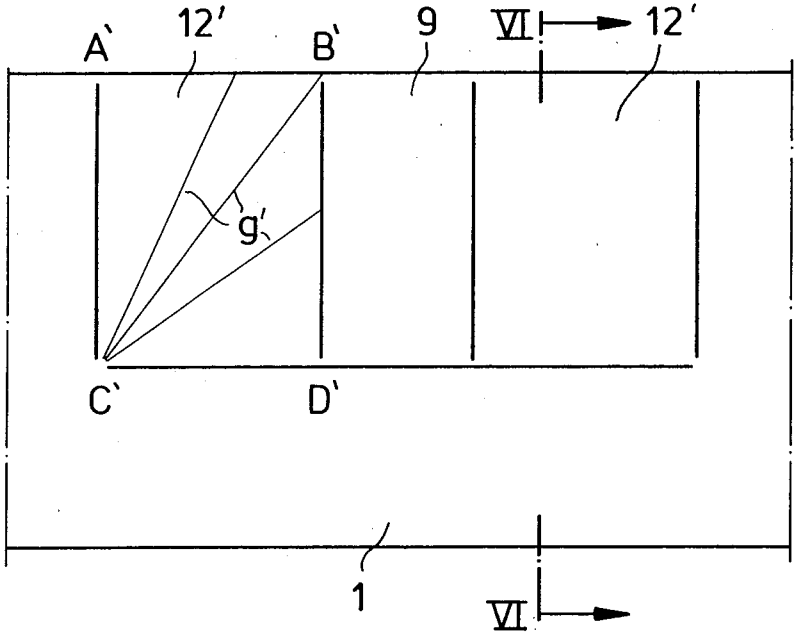
FIG. 5 is a diagramatic view of the inner faces of the mold in the pouring zone and below.

According to the illustrative embodiment in FIG. 5, the substantially rectangular area A'B'C'D' is in the form of a twisted ribbon and its contour is formed with slightly curved lines g' which fan out from point C' and are connected to each point along the horizontal lines A'-B', and B'-D'. In this way the bending angle of the stock as it flows over line C'D' diminishes from the maximum at point D' to zero (i.e., 180 degrees reflex angle) at point C' along the line C'-D'.

Figure 4:
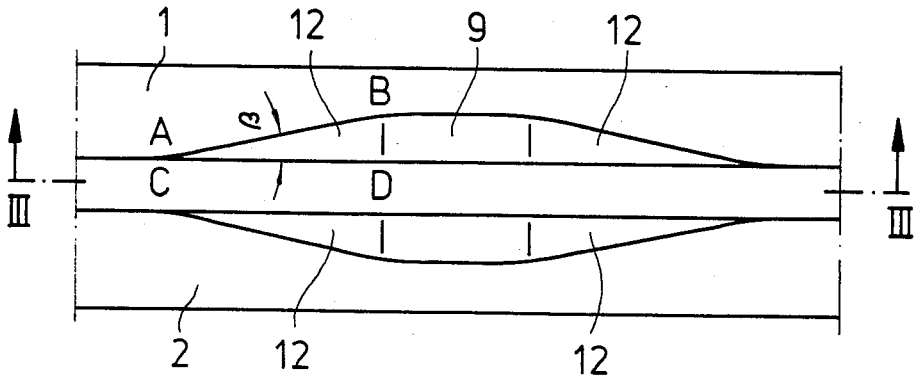
FIG. 4 is a diagramatic plan view looking down on the mold explaining the angular relationships.

In this embodiment of FIG. 4, the line A-B beyond point B is curved. In the embodiment of FIG. 6, the angles around the corner along the lines C'-A', and/or C'-D' are faired to facilitate smooth transition.

Having now described illustrative embodiments, various modifications of the invention will become apparent to those skilled in the art. For example, the lines C-D or C'-D' need not be precisely horizontal, and they can extend the entire distance to the narrow walls of the mold without departing from the spirit of the invention. Likewise, the area ABCD can extend up to the centerline of the mold, and need not have the precise shape of a twisted ribbon as long as the reflex angle over which the stock must flow at the lower substantially horizontal line gradually diminishes as it moves laterally. Therefore, it is not the intention to confine the invention to the precise form herein shown but rather to limit it solely in terms of the appended claims.

I claim:

1. A mold for continuously casting strip metal comprising:

a pouring tube for pouring molten metal, a transversely narrow mold cavity formed by broad and narrow walls, said cavity having an inlet at one end of the mold and an outlet at the other end, said cavity positioned to receive molten metal from said tube, flared walls in the inlet end of said cavity defining a widened pouring zone which tapers inwardly in the direction of flow of said metal to a point downstream in said mold at which the walls become parallel to form a reflex angle corner, lower ends of the flared walls of said pouring zone terminating along a transversely extending line which is substantially normal to the axis of flow of said metal, and the reflex angle betwee said flared walls over which the stock bends as it moves through the mold and the axis of the stock flow at a maximum angles (alpha) in the area of the centerline of the mold and diminishing gradually to 0 degrees toward the narrow sides of the mold cavity along said transversely extending line.

2. The mold defined in claim 1 further characterized by:

a reflex angle of 10 or less degrees.

3. The mold defined in claim 1 further characterized by:

said transversely extending line being at right angles to the axis of stock flow.

4. The mold defined in claim 1 further characterized by:

said flared walls in said pouring zone defining substantially twisted rectangular faces extending upwardly from said transversely extending line and teminating at the inlet end of said mold.

5. The mold defined in claim 4 further characterized by:

the contour of the said substantially twisted rectangular faces is defined by straight lines between vertically corresponding points of said transversely extending line and an inlet end line at the inlet end of said mold.

6. The mold defined in claim 4 further characterized by:

said substantially rectangular faces having a contour substantially in the shape of a twisted ribbon.

7. The mold defined in claim 1 further characterized by:

the corner along said transversely extending line being faired.

8. The mold defined in claim 1 further characterized by:

the contour of the upper end of said flared walls of said pouring zone being a straight line from the side of said pouring zone to a point near the middle of said zone.

9. The mold defined in claim 1 further charaterized by:

the contour of the upper end of said flared walls of said pouring zone being a curved line from the side of said pouring zone to a point near the middle of said zone.

* * * * *